US005935018A

United States Patent [19]

Takeda

[11] Patent Number: 5,935,018

[45] Date of Patent: Aug. 10, 1999

[54] GOLF CLUB AND METHOD OF MANUFACTURING THEREFOR

[75] Inventor: Hitoshi Takeda, Tsubame, Japan

[73] Assignee: Kabushiki Kaisha Endo Seisakusho, Niigata-ken, Japan

[21] Appl. No.: 09/152,936

[22] Filed: Sep. 14, 1998

[30] Foreign Application Priority Data

Mar. 23, 1998 [JP] Japan ..... 10-074078

[51] Int. Cl.[6] ..... A63B 53/04

[52] U.S. Cl. ..... 473/324; 473/342; 473/349

[58] Field of Search ..... 473/324, 349, 473/350, 329, 342; 148/414, 680, 681, 679, 682

[56] References Cited

U.S. PATENT DOCUMENTS 2,669,534 2/1954 Richardson ..... 148/682
4,594,117 6/1986 Pryor et al. ..... 148/414
5,207,427 5/1993 Saeki ..... 473/330
5,676,605 10/1997 Kobayashi ..... 473/331

FOREIGN PATENT DOCUMENTS 63-267376 11/1988 Japan .
8-294553 11/1996 Japan .

*Primary Examiner*—Klen T. Nguyen
*Attorney, Agent, or Firm*—Quarles & Brady LLP

[57] ABSTRACT

A golf club and a manufacturing method therefor which can prevent a copper or copper alloy material for a head from corroding. The invention also aims at preventing electrification corrosion when combining this material with another material such as aluminum alloy. A head body 31 forming a peripheral portion of a head 1 is made of beryllium copper. A face member 32 pressed into a through-hole 33 of the head body 31 is made of aluminum alloy. A surface of the head body 31 is formed with a lower plating such as nickel plating, onto which is formed an upper plating such as chrome plating. By this plating, not only the corrosion of the head body 31 itself but also that of the face member 32 due to galvano-corrosion can be prevented.

6 Claims, 3 Drawing Sheets

GOLF CLUB AND METHOD OF MANUFACTURING THEREFOR

BACKGROUND OF INVENTION

1. Field of Invention

The present invention relates to a golf club and a manufacturing method therefor, particularly to a head and method of manufacturing thereof.

2. Prior Art

Conventionally, not only steel and titanium alloy but also copper or copper alloy has been used for the material of a golf club such as iron golf club. For such copper alloy, Japanese Patent Un-Examined Publication No. 63-267376 proposed to use beryllium copper alloy. Beryllium copper alloy which has a good flexibility as taught by the publication, has been used, for example, for adjustment of weight distribution, taking advantage of its relatively large specific gravity. On the other hand, Japanese Patent Un-Examined Publication No. 8-294553 taught that an annular head body made of beryllium copper comprises a face member made of less dense material than beryllium copper, such as aluminum alloy, said face member being pressed into the inside of the head body. This aimed at enlarging a sweet area, i.e., an area on the face where balls can travel comparatively straight and well when struck thereupon, through the dispersion of the weight of the head toward its periphery.

In general, beryllium copper is yellow, having an appearance more bright and lustrous than copper, and thus such appearance is preferred by people. However, beryllium copper is liable to get blackish due to corrosion, so that its gloss is lost soon or later. At that stage, its appearance would lack in attractiveness. Particularly for golf clubs, they are used outdoors and given impacts in striking balls. In other words, they are often scratched and damaged not only by impacts of balls, but also by strong contacts with lawn, green and the like which include moisture and agricultural chemicals, so that corrosion proceeds more rapidly. The problem of corrosion is perceived not only in beryllium copper but also in copper and other types of copper alloy.

For a means for preventing such corrosion, wax-coating was proposed, which, however, has such a poor durability that golf clubs thus coated would be liable to cause the problems of the damage and/or the stripping off of the coating under the above-mentioned severe condition in using the same.

Whereas, with the golf club head utilizing a combination of beryllium copper with aluminum alloy or the like, as disclosed in the aforesaid Japanese Patent Un-Examined Publication No. 8-294553, there is another problem that aluminum alloy causes an electrification corrosion, such as so-called galvano-corrosion. Galvano-corrosion is caused, for example, due to a kind of a battery being formed between two different metals, one being a noble metal, the other a base metal.

SUMMARY OF THE INVENTION

To eliminate the above problems, it is, therefore, a first object of the invention to provide a golf club which can prevent the corrosion of a head made of copper or copper alloy.

It is a second object of the invention to provide a golf club which can prevent the electrification corrosion of a head made of a combination of copper or copper alloy with other materials.

Also, it is a third object of the invention to provide a method of manufacturing a golf club which can improve the strength of a head made of beryllium copper, with improved productivity as well as insured plating.

From a first aspect of the invention, there is proposed a golf club having a head, said head being constructed by one or more materials including copper or copper alloy, wherein anti-corrosion plating is provided on a surface of said copper or copper alloy material of the head.

From a second aspect of the invention, there is proposed a golf club as set forth in the first aspect, wherein said plating consists of a lower plating which is a nickel plating formed on a surface of the copper or copper alloy material, and an upper plating formed on a surface of the lower plating.

From a third aspect of the invention, there is proposed a method for manufacturing a golf club having a head, said head being constructed of a beryllium copper material, wherein a method for manufacturing said material comprises the processes of: a) a forging process for forging said material; b) a solution heat treatment for allowing said material after being forged to go through solution heat treatment; c) a machining process for machining said material after the solution heat treatment; d) an age hardening treatment for allowing the machined material to go through age hardening treatment; e) an oxide film removing process for removing an oxide film formed on a surface of the material during the age hardening treatment; and f) a plating process for plating a surface of the material after the oxide film removing process.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DETAILED DESCRIPTION OF THE PREFERRED EMBODIMENTS

Figure 1:
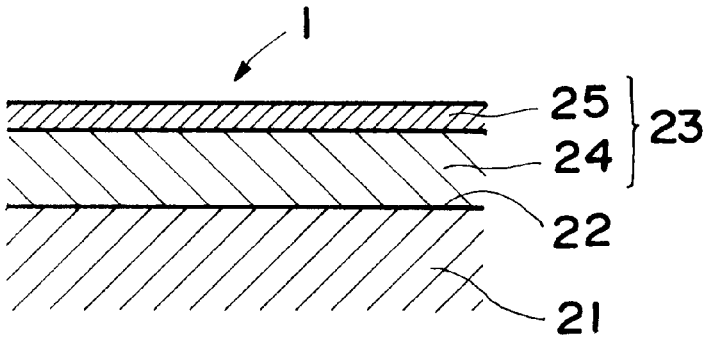
FIG. 1 is an enlarged section showing a surface of a head of a first embodiment of a golf club of the invention.

Hereinafter is explained a first embodiment of a golf club of the invention with reference to FIG. 1 through FIG. 3.

Figure 2:
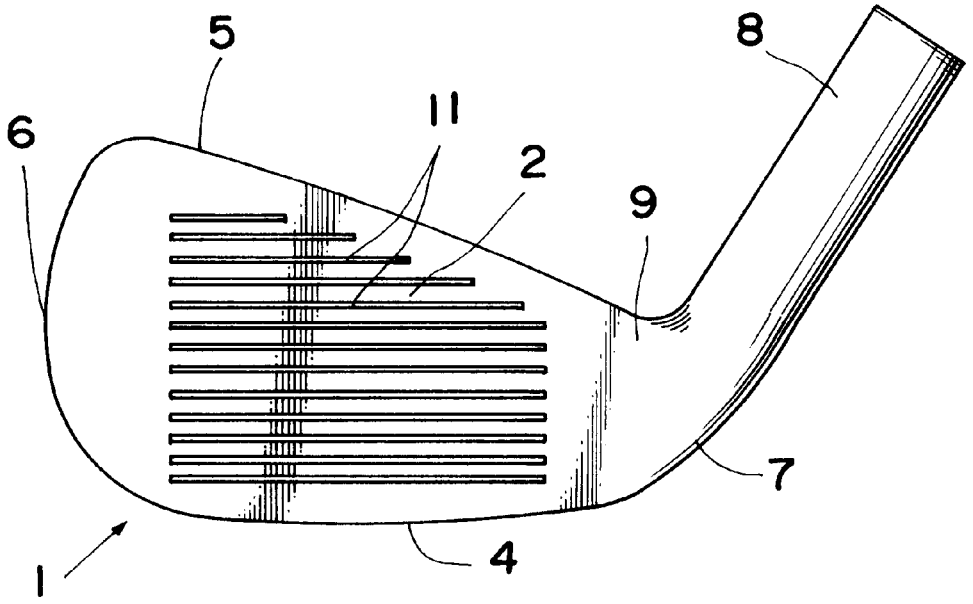
FIG. 2 is a front view showing the whole head of a first embodiment of the invention.
Figure 3:
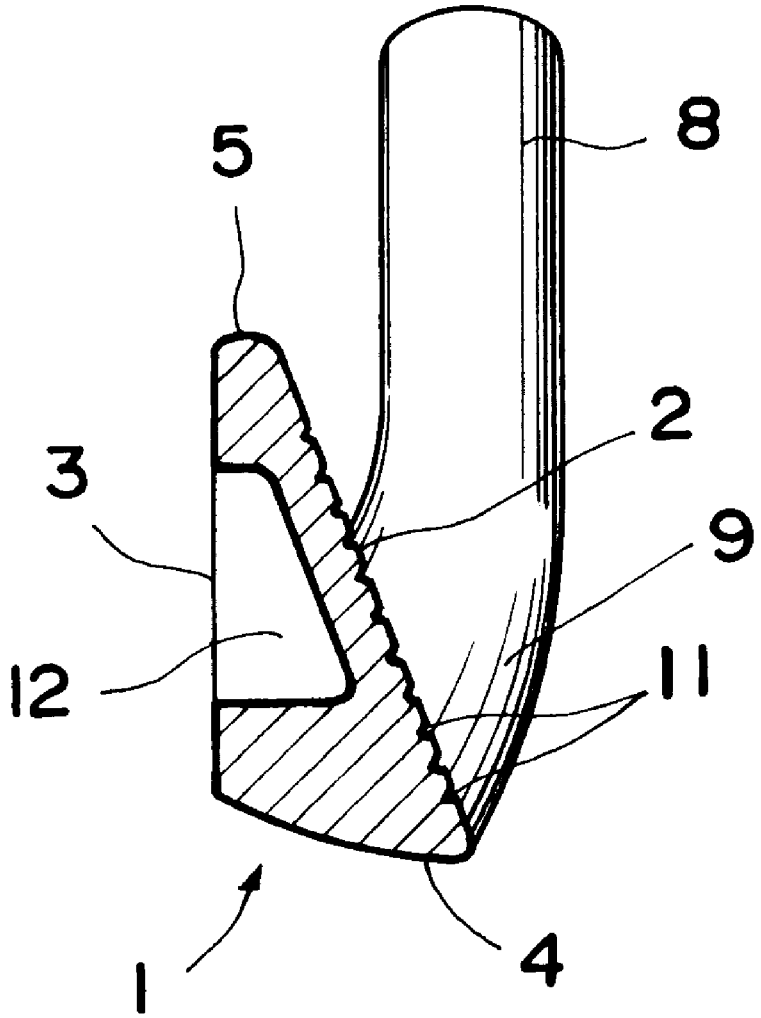
FIG. 3 is a section showing the whole head of a first embodiment of the invention.

A golf club of the first embodiment is an iron club, having a head 1 whose whole view is illustrated in FIGS. 2 and 3. Reference numeral 2 designates a face as a striking front face thereof, 3 a back as a back face thereof, 4 a sole as a lower face, 5 a top as an upper face, 6 a toe at its proximal side, 7 a heel at its distal side, and 8 a hosel provided at the heel 7 side across a neck 9, respectively. The hosel 8 serves as a shaft connecting portion for connecting a shaft 10 thereto. The face 2 is formed with score lines 11, while the back 3 of the head 1 is formed with a cavity 12 for enlarging a sweet area by dispersing the weight of the head 1 toward its periphery.

Reference numeral 21 designates a basic material of the head 1, which is wholly constructed of the same material, said material being beryllium copper falling under the category of copper alloy. As illustrated in FIG. 1, anti-corrosion plating 23 is provided on a surface 22 of the ground basic material 21. The plating 23 consists of a lower plating 24 formed of nickel plating on the surface 22 of the basic material 21, and an upper plating 25 formed on the lower plating 24. The lower plating 24 is about 20 micrometers thick. For the upper plating 25 can be employed chrome plating, boron plating or tinning. The thickness of the upper plating 25 is, from standpoints of strength and costs, desirably about 5 micrometers for chrome plating, about 3 micrometers for boron plating, and about 2 micrometers for tinning.

It should be noted that the structure and materials for the plating should not be limited to the foregoing. For the lower plating 24 formed of nickel plating which has a stronger property of noble metal, however, it should be desirably provided for the purpose of preventing corrosion and making it easier for the upper plating 25 to adhere thereto. For the upper plating 25, it should also be provided for the purpose of obtaining suitable appearance. Incidentally, a method of plating may be electroplating, which however should not be limited thereto.

Beryllium copper which constructs the head 1 can be prevented from corroding, by providing the above-mentioned plating 23 on the surface of the basic material 21 formed of beryllium copper. Accordingly, the deterioration of the performance and attractiveness of the head 1 due to corrosion can be prevented. Unlike the head whose surface is formed with a coating, using wax or the like, the plating 23 has such a good durability that damages to the head 1 such as the peeling off of the plating 23 therefrom can be suppressed, even when the golf club thus plated is used outdoors, subjected to impacts in striking balls. In addition, the plating 23 can be provided at relatively inexpensive costs.

Next, one example of methods for manufacturing the head 1 will be explained.

Initially, a basic material of beryllium copper is hot forged, so that a head constructing material is formed to a shape similar to that of the head 1 (forging process). Then, the head constructing material is allowed to go through solution heat treatment (solution heat treatment process). In this solution heat treatment process, the head constructing material is heated at 780 to 830 degrees centigrade for about two hours in a heating furnace, which is then water-cooled quickly. Through this solution treatment process, the head constructing material is converted into solid solution, and the head constructing material is softened so that the value of the hardness thereof is lowered for example to $H_R$ B75 or below. Then, the head constructing material thus converted into solid solution is machined so as to form a product shape of the head 1 (machining process). For such machining, cutting, cold pressing, grinding or the like may be employed. Thereafter, the head constructing material is allowed to go through age hardening treatment (age hardening process). In this age hardening process, the head constructing material is maintained at for example 315 degrees centigrade for about three hours in a heating furnace, which is then cooled moderately under ordinary temperature. Thus, the head constructing material formed of beryllium copper is hardened with age until it reaches an intermediate state between supersaturated solid solution and perfect precipitation, so that the hardness is enhanced, thereby obtaining the hardness of about $H_R$ C40 for example.

In the foregoing manufacturing process, the surface of the head constructing member is formed with an oxide film due to the thermal treatment such as age hardening process, so that the surface thereof gets blackish, thus preventing the insuring of forming the plating 23 on the surface of the head constructing material. Therefore, after the aforesaid age hardening process, the oxide film is removed by for example grinding the surface of the head constructing material (oxide film removing process). Thereafter, the plating 23 is provided on the surface of the head constructing material (plating process), thereby finishing the head 1.

According to the foregoing manufacturing method of the head 1, the strength of beryllium copper that is the material of the head can be improved, through the solution heat treatment and age hardening process. For example, the tensile strength is greatly improved up to as high as 1200 to 1300 $N/mm^2$, in contrast with about 590 $N/mm^2$ of beryllium copper that undergoes neither the solution heat treatment nor the age hardening treatment. Further, as the machining process is carried out after the solution heat treatment but prior to the age hardening process, the process is easy to carry out, thus displaying good productivity. Furthermore, despite the oxide film formed on the surface of the head constructing material due to the thermal treatment such as the age hardening treatment, the plating 23 can be insured through the removal of the oxide film.

Figure 4:
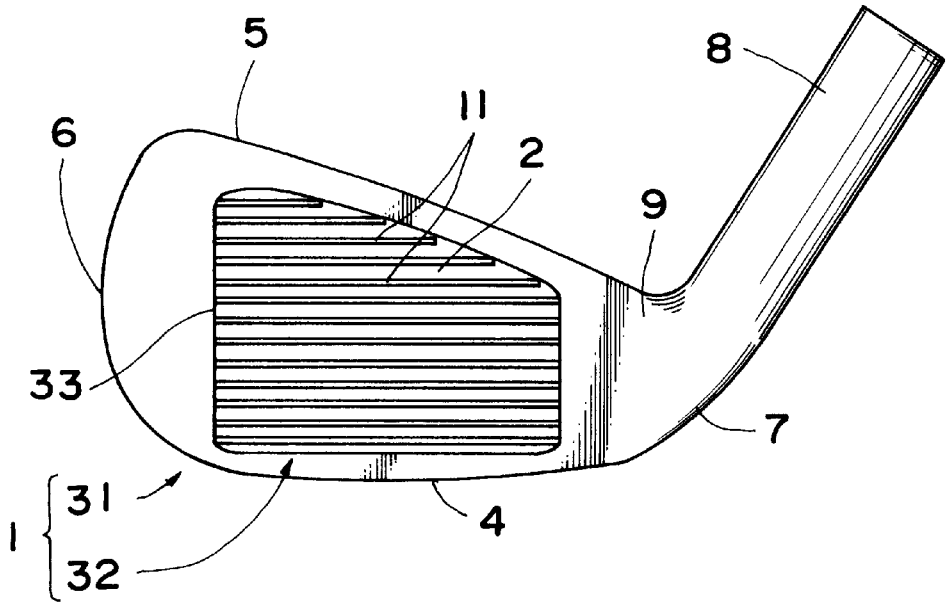
FIG. 4 is a front view showing a head of a second embodiment of the invention.
Figure 5:
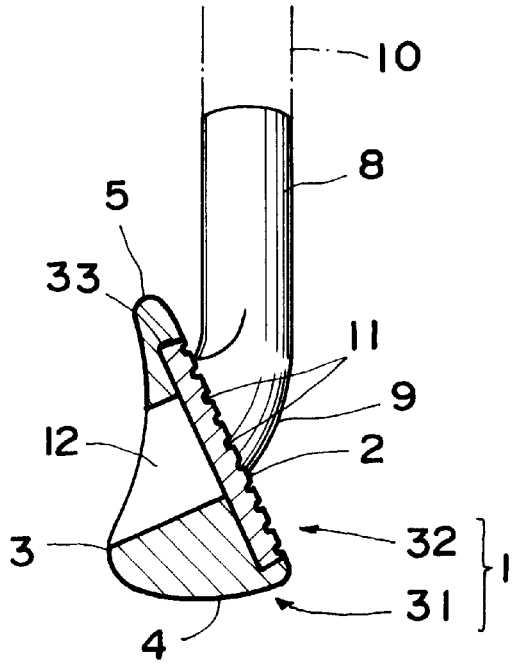
FIG. 5 is a section showing the head of a second embodiment of the invention.

Next, a second embodiment of the invention is explained with reference to FIGS. 4 and 5. The second embodiment also takes an example of an iron club, in which the same portions as those described in the foregoing first embodiment are designated by the same reference numerals, and their repeated detailed descriptions will be omitted.

The head 1 in accordance with the second embodiment is constructed by two structural elements, one being a head body 31 and the other a face member 32. The head body 31 is formed of beryllium copper, which constructs the hosel 8 and the peripheral portion of the head 1 including the sole 4, top 5, toe 6 and heel 7. The head body 31 is formed annular, having a through-hole 33 in the center thereof, said through-hole 33 penetrating from the face 2 through the back 3. On the other hand, the face member 32 or the other structural element is nearly tabular, formed of aluminum alloy whose specific gravity is smaller than that of beryllium copper. The face member 32 is fixed in the through-hole 33 of the head body 31 by means of press-fitting or the like, thereby forming the face 2. It should be noted that the face member 32 is only located at the front side of the head 1 so as to allow the through-hole 33 to form the cavity 12 behind the face member 32.

With the structure where the front side of the central portion of the head 1 is formed of aluminum alloy while the remaining portion thereof is formed of denser beryllium copper, the weight of the head 1 is distributed or dispersed toward the peripheral portion relative to the face 2, at the same time that the center of gravity of the head 1 is located a longer distance away from the face 2 to the rear direction, whereby a sweet area is enlarged.

Like the foregoing first embodiment, the anti-corrosion plating 23 is provided on the surface of the head body 31 made of beryllium copper, while no plating is provided on the face member 32.

Whereas, it is noted that aluminum alloy is a basic metal, but beryllium copper is closer in its properties to a noble metal than the former. In other words, with the combination of aluminum alloy with beryllium copper, an electrification corrosion or so-called galvano-corrosion is prone to occur on the aluminum alloy, with the aluminum alloy behaving as anode, while the beryllium copper as cathode. Further, for golf clubs used outdoors, corrosion is liable to proceed due to impure water or the like present in a golf course which works as electrolyte for facilitating the corrosion.

In accordance with the head 1 of the second embodiment of the invention, however, as the plating 23 is provided on the surface of the head body 31 made of beryllium copper, corrosive reaction between the head body 31 and the face member 32 made of aluminum alloy is prevented, thereby preventing the electrification corrosion of the face member 32. Accordingly, the deterioration of the performance of the head 1, e.g., the deterioration of connection strength between the head body 31 and the face member 32 due to corrosion, can be prevented. For example, the detachment of the face member 32 from the head body 31 as well as the displacement of the former relative to the latter due to impacts in striking balls, can be prevented. In addition, like the first embodiment, the corrosion of beryllium copper itself which constructs the head 31, can be prevented owing to the plating 23.

Incidentally, the present invention should not be limited to the foregoing embodiments, but may be modified within a scope of the invention. For example, although beryllium copper was chosen as a material to be plated, constructing the head constructing member in the foregoing embodiments, it may be copper or another type of copper alloy. Further, in the case of constructing the head by combining different materials together like in the foregoing second embodiment, the head may be divided in a different manner than the second embodiment. For example, the face may be constructed by the head body made of aluminum alloy or the like, with a balance weight made of beryllium copper being fixed to the lower part of the back of the head body. Alternatively, the combination of materials should not be limited to that of beryllium copper and aluminum alloy. What should be noted when combining materials susceptible to electrification corrosion, is that it is very effective to plate the head constructing member made of either copper or copper alloy.

Although an iron club was taken for an example in the foregoing embodiments, the present invention may apply to various kinds of head constructing members such as a putter club head, a balance weight for a wood club head and the like.

What is claimed:

1. A golf club head, comprising: a first material consisting essentially of beryllium copper, and a second material constructed as part of the head by joining to the first material, the second material consisting essentially of an aluminum alloy which normally causes electrification corrosion when joined to the first material, and an anti-corrosion plating provided on a surface of said first material to prevent electrification corrosion when said second material is joined to the first material.

2. A golf club head according to claim 1, wherein said plating consists of a lower plating which is a nickel plating formed on a surface of the first material, and an upper plating formed on a surface of the lower plating.

3. A golf club head according to claim 2, wherein the the nickel plating has a thickness of about 20 micrometers.

4. A golf club head according to claim 2, wherein said upper plating is made of a material selected from a group consisting of chrome plating, boron plating and tinning.

5. A golf club head according to claim 4, wherein said upper plating has a thickness in a range from about 2 micrometers to about 5 micrometers.

6. A method for manufacturing a golf club having a head, said head being constructed of a first material of a beryllium copper material and a second material of an aluminum alloy which absent the following steps causes electrification corrosion when joined to the first material, wherein a method for manufacturing said material comprises the processes of:

a forging process for forging said first material;

a solution heat treatment for allowing said first material after being forged to go through solution heat treatment;

a machining process for machining said first material after the solution heat treatment;

an age hardening treatment for allowing the machined first material to go through age hardening treatment;

an oxide film removing process for removing an oxide film formed on a surface of the first material during the age hardening treatment; and a plating process for plating a surface of the first material after the oxide film removing process.

* * * * *